US005913618A

United States Patent [19]

Yosha

[11] Patent Number: 5,913,618

[45] Date of Patent: Jun. 22, 1999

[54] UNITARY CREDIT CARD AND PAPER MONEY CLIP

[76] Inventor: Victor J. Yosha, 7276 Orion St., Golden, Colo. 80403

[21] Appl. No.: 08/566,008

[22] Filed: Dec. 1, 1995

[51] Int. Cl.[6] ..... G09F 3/20

[52] U.S. Cl. ..... 40/658; 24/3.12

[58] Field of Search ..... 40/658, 642; 24/563, 24/3.12, 67.9

[56] References Cited

U.S. PATENT DOCUMENTS

| | | | |
|---|---|---|---|
| 1,815,024 | 7/1931 | Foster | 40/658 |
| 2,618,086 | 11/1952 | Komorous | 24/3.12 X |
| 3,955,296 | 5/1976 | Kapstad | 40/658 |
| 4,056,139 | 11/1977 | Murt . | |
| 4,654,631 | 3/1987 | Kurcbart et al. | 24/3.12 X |
| 4,889,380 | 12/1989 | Pillifant, Jr. | 40/658 X |
| 4,937,963 | 7/1990 | Barnes | 40/642 |
| 5,077,869 | 1/1992 | Haase . | |
| 5,115,909 | 5/1992 | Hull et al. . | |
| 5,184,375 | 2/1993 | Hogt | 24/3.12 |
| 5,279,019 | 1/1994 | Knickle . | |
| 5,358,019 | 10/1994 | Sumner, III . | |
| 5,520,230 | 5/1996 | Sumner, III | 24/563 X |

OTHER PUBLICATIONS

Article "Identification Cards—Recording Technique—Part 2: Magnetic Stripe" International Standard 7811/2, 1985.

Article Identification Cards—Recording Technique—Part 4: Location of Read Only Magnetic Tracks—Tracks 1 and 2, International Standard 7811/4, First Edition—1985—1985–12–15.

International Standard 7811/5, Part 5: Location of Read—Write Magnetic Track—Track 3, First Edition—1985–12–15.

*Primary Examiner*—Joanne Silbermann

*Attorney, Agent, or Firm*—Francis A. Sirr; Earl C. Hancock; Holland & Hart llp

[57] ABSTRACT

A unitary, pocket size, plastic assembly includes a flat, rectangular, credit-card portion that carries a machine-readable data-containing medium, such as a semiconductor chip or a magnetic stripe. An integral and resilient clasp is formed along a linear edge of the flat credit-card portion, so as to overhang and resiliently engage the body of the flat credit-card portion. Paper money, in a folded or in a flat state, is inserted under the clasp and is securely held between the credit-card portion and the clasp in the manner of a money clip.

16 Claims, 5 Drawing Sheets

UNITARY CREDIT CARD AND PAPER MONEY CLIP

BACKGROUND OF THE INVENTION

1. Field of the Invention

This invention relates to the field of article holders having a resilient clasp, and more specifically to a unitary assembly that comprises a data card and a resilient clasp or clip under which paper currency and the like may be inserted and removably stored.

2. Description of the Related Art

The art contains a number of teachings relative to an assembly that provides for both the storage of money and the storage of an accessory item, such as a card(s) and/or a key(s).

For example, U.S. Pat. No. 4,056,139 provides a multi-clip device for holding money, cards, and the like under the plurality of clips.

In U.S. Pat. No. 5,077,869, a money clip is provided with an resilient , elastic, strap for removably holding a credit card to the money clip.

U.S. Pat. No. 5,115,909 provides a money clip that is formed from clear extruded plastic, wherein the clip portion holds currency, wherein a compartment holds a document, such as a credit card or a driver's license, and wherein a pouch holds an emergency car key or house key.

U.S. Pat. No. 5,279,01 provides a credit card that is encircled by an endless elastic band under which foldable currency; i.e., paper money or denominational money bills may be stored.

U.S. Pat. No. 5,358,019 provides a generally flat and unitary holder having two identical mirrored bends that are formed on the front side thereof, these two bends being spaced apart so as to removably hold two or more cards, and having a curved spring bend that returns to the back side of the holder, this curved spring bend forming a money clip.

While the prior art as above exemplified is of limited utility for its stated purposes, the need remains in the art for a unitary data/credit card and paper money holder wherein a plastic assembly includes a flat, rectangular, credit-card portion that carries an encoded semiconductor chip, or an encoded magnetic strip, wherein a linear edge includes a spring clasp under which paper currency may be inserted and stored.

SUMMARY OF THE INVENTION

The present invention provides a combined data/credit card and money clip in a unitary assembly; i.e., a one-piece assembly.

While the term "credit card" will be used to describe the invention, it is to be understood that the spirit and scope of the invention is not to be limited to only this utility, since the present invention finds utility in a combined data-card/money-clip assembly wherein a data-carrying element (for example, a semiconductor chip or a magnetic stripe), contains data relating to items, such as personal identification, medical history/condition, driver's license data, magnetic keys, etc.

In addition, while the data-carrying element of preferred embodiments of the invention comprise a well-known semiconductor chip or a well known magnetic stripe, the spirit and scope of the invention is to include any data carrying element that can be automatically read by an accessory reader; for example, an insert reader, a swipe reader, or a capture reader.

In the utility to be described, the invention provides a money clip that is fabricated as an integral unit with a credit card, i.e., it comprises a flat, rectangular, and plastic credit card portion that carries a data carrying element readable by insertion into a conventional card reader. An edge of this credit card portion (for example, the top edge) is folded over, or it is formed with a permanent or releasable extension, so as to physically engage the surface of the flat credit card portion with generally line contact, thereby forming a money clip portion. Paper currency, in a flat or in a folded state, can then be inserted under this money clip portion.

In view of the general utility of the data-carrying portion of the present invention, the data structure and protocol will not be described herein.

The art of data-carrying cards, such as credit cards, is covered by a number of well known industry standards. International Standard Organization (ISO) standard 7811/2 entitled "Identification cards—Recording technique—Part 2: Magnetic stripe"; ISO standard 7811/4 entitled "Identification cards—Recording technique—Part 4: Location of read-only magnetic tracks—Tracks 1 and 2"; and ISO standard 7811/5 entitled "Identification cards—Recording technique—Part 5: Location of read-write magnetic track—Track 3" are incorporated herein by reference.

In addition, the following ISO documents pertaining to smartcards (i.e., identification cards having integrated circuits with contacts) are also incorporated herein by reference: ISO 7816-1:1987 Part 1 Physical Characteristics; ISO 7816-2:1988 Part 2 Dimensions and location of the contacts; ISO/IEC 7816-3:1989 Part 3 Electronic signals and transmission protocols; ISO/IEC UIS 7816-4 Part 4 Interindustry commands for interchange; ISO/IEC 7816-5:1994 Part 5 Numbering systems and registration procedure for application identifiers; ISO/IEC CD 7816-6 Part 6 Inter-industry data elements.

The invention will be apparent to those of skill in the art upon reference to the following detailed and enabling description of the best modes of the invention, which description makes reference to the drawing.

DESCRIPTION OF THE PREFERRED EMBODIMENT

Figures 1, 3:
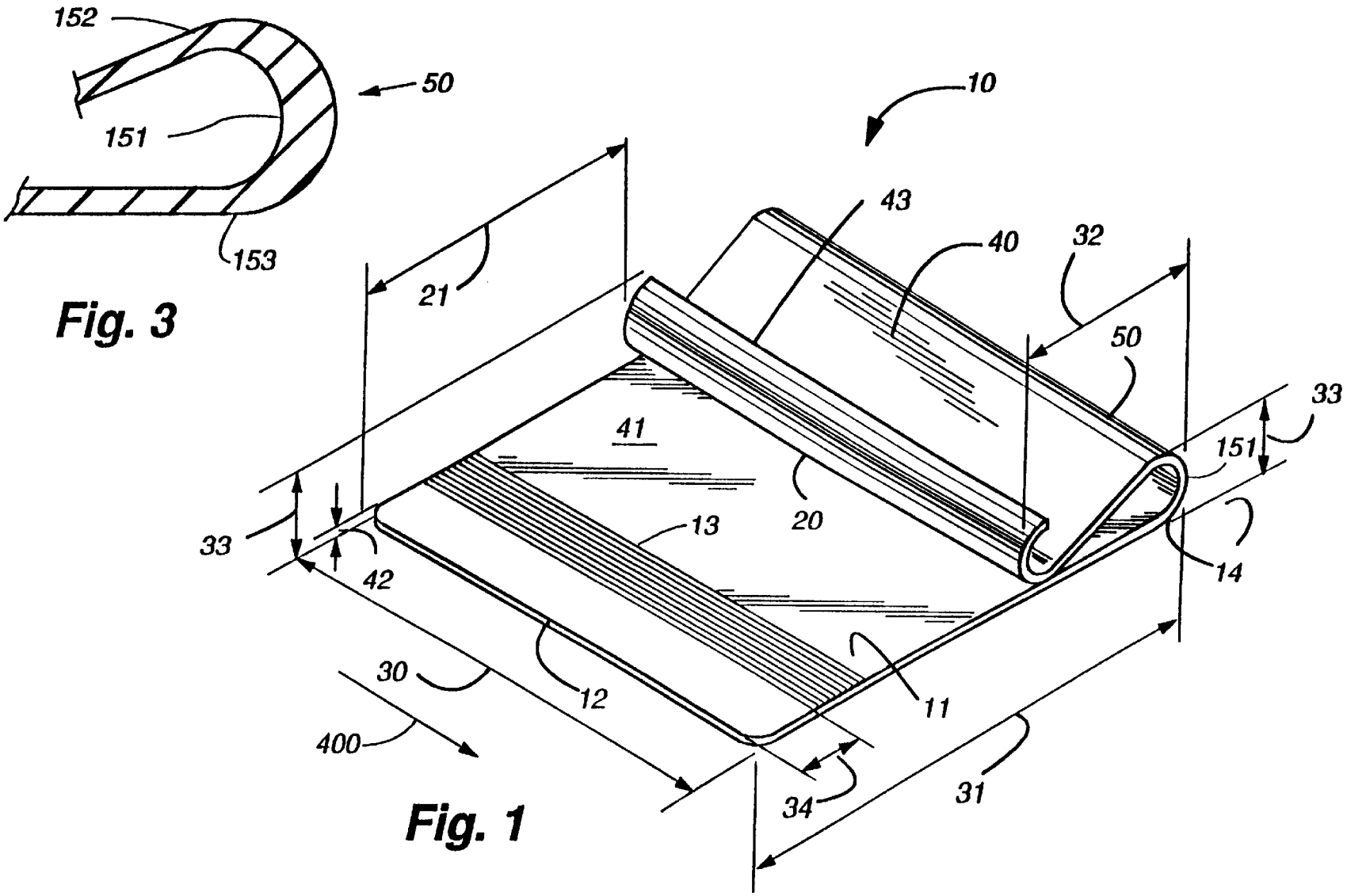
FIG. 1 is a perspective view of a first embodiment of a unitary magnetic-stripe data/credit card and paper money clip in accordance with the invention wherein the unitary device is extruded as one plastic member.
FIG. 3 is a side view of a portion of the device of FIG. 1.

With reference to FIG. 1, this embodiment of the present invention provides a unitary, pocket size, plastic assembly 10 that includes a flat, rectangular, credit-card portion 11. The bottom linear edge 12 of portion 11 carries a magnetic credit/data strip 13 that is spaced from bottom edge 12 by about 0.218-inch. Strip 13 extends generally parallel to bottom edge 12.

An integral clasp or resilient clip portion 40 is formed along the linear top edge 14 of flat credit-card portion 11. Clip portion 40 overhangs and physically engages the top surface of flat credit-card portion 11 with generally a line-contact. Clip portion 40 includes a linear, partial cylinder, and generally 270-degree fold 50 having a radius which in a preferred embodiment was about 0.13-inch.

Paper money, in a folded or in a flat state, is manually inserted under clip 40, and is securely held by the tension within upward deflected clip 40, much in the manner of a money clip.

Preferably, the lower edge 20 of clip 40 includes an upturned partial cylinder portion 43 whose radius in a preferred embodiment was about 0.10-inch. Portion 43 terminates to provide dimension 33 of about 0.32-inch.

Lower edge 20 of clip portion 40 is positioned a minimum distance 21 above bottom edge 12 of credit-card portion 11, so as not to physically interfere with the insertion of assembly 10 into well known automatic credit card readers (not shown).

In a preferred embodiment of the invention, dimension 30 was about 2.00-inch, dimension 31 was about 2.13-inch, dimension 32 was in the range of from about 0.75 to about 1.00-inch, dimension 33 was about 0.32-inch, and dimension 21 was in the range of from about 1.38 to about 1.13-inch. Assembly 10 was of generally uniform thickness 42 throughout portions 11 and 40; for example, about 0.03-inch thick.

The physical size of data stripe 13 is not critical to the invention, and meets the requirements of well-known standards defining such a magnetic stripe. While not required, data stripe 13 usually is horizontal, and as long as the lower edge 12 of credit card portion 11. The vertical height 34 of data stripe 13 is generally as is defined by standards that cover such data cards.

In a preferred embodiment of the invention, assembly 10 was formed of a plastic selected from the group PVC, ABS, and plastic materials having similar properties.

Fabrication of assembly 10 results in an integral clasp, or money clip portion 40, that is spring biased toward, and physically engages, the underlying top surface 41 of credit card portion 11 in a generally line contact that extends generally parallel to bottom edge 12. For example, plastic assembly 10 may be manufactured using an extrusion process. After extrusion, the assembly is allowed to cool, and while cooling, physical pressure or force is applied to portion 40 so as to cause portion 40 to bend down and physically engage underlying top surface 41. This force is maintained until assembly 40 has completed cooling, whereupon the force is released. This procedure ensures reliable line-type closure of clip portion 40 down onto the top surface 41 of credit card portion 11.

FIG. 3 shows a modification to clip portion 40, so as to facilitate the above-described method of manufacture. In this construction and arrangement, cylinder fold 50 is extruded so that the middle and linear portion 151 of its generally 270-degree reentrant curved portion is somewhat thicker than the two end portions 152,153 of this curved portion 50.

In use, it is contemplated that currency that resides under clip portion 40 will be removed prior to insertion of data stripe 13 into a data reader.

Figure 2:
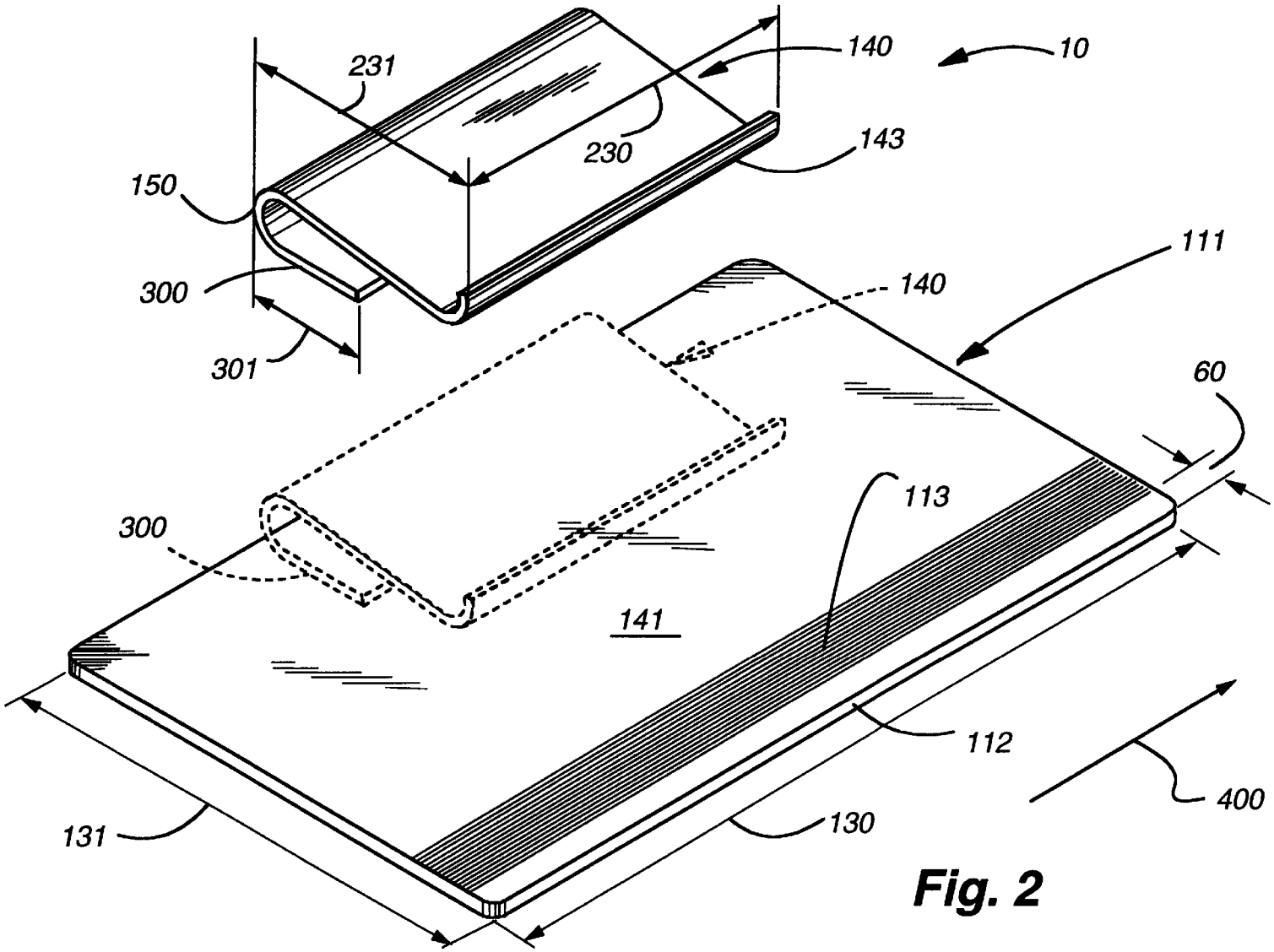
FIG. 2 is a perspective view of a second embodiment of a unitary data/credit card and paper money clip in accordance with the invention wherein the unitary device is formed by the permanent physical attachment of a first money clip portion to a second credit card portion, to thereby form one unitary member.

FIG. 2 is a perspective view of a second embodiment of a unitary data/credit card and paper money clip 10 in accordance with the invention. In this embodiment of the invention, unitary device 10 is formed by the permanent, physical attachment of a first money clip portion 140, to a second credit card portion 111, to thereby form one unitary member 10.

In this embodiment of the invention, magnetic data stripe 113 is spaced a short distance 60 of about 0.218-inch above the lower edge 112 of credit card portion 111.

While not critical to this embodiment, clip portion 140 does not extend the entire width 130 of credit card portion 111, and clip portion 140 is generally centered on credit card portion.

In an embodiment of FIG. 2, dimension 130 was about 3.32-inch, dimension 230 was about 1.50-inch, dimension 131 was about 2.06-inch, dimension 231 was about 1.00-inch, and money clip bends 10 and 143 were formed on about a 0.13 radius, and about a 0.06-inch radius, respectively.

As shown in dotted line in FIG. 2, clip portion 140 is provided with an extension 300 that is permanently bonded to the lower side, or bottom surface of credit card portion 111 (i.e., the side opposite top side 141) by well known and noncritical means, so as to provide a smooth top surface 141 for the insertion of paper money under clip portion 140. Example bonding techniques include ultrasonic bonding, and chemical bonding, such as can be achieved by using MEK. In an embodiment of the invention, dimension 301 was about 0.50-inch.

As described relative to FIG. 1, the plastic material from which credit card portion 111 and clip portion 140 are formed, can be selected from the group PVC, ABS, plastic materials having similar properties, and blends of such materials. In addition, the thickness of credit card portion 111 and clip portion 140 is preferably as above described; i.e., about 0.30-inch.

As will be appreciated by those of skill in the art, data stripe 13 of FIG. 1 and data stripe 113 of FIG. 2 can be placed on either the top surface or on the bottom surface of the respective credit card portions 11 and 111, as is desired.

In addition, the magnetic stripes above described relative to FIGS. 1 and 2 may be either of the flush type, or the raised type relative to the surface of top side 141. These data stripes are usually read by a swiping action, as represented by arrows 400 in FIGS. 1 and 2.

Figure 4:
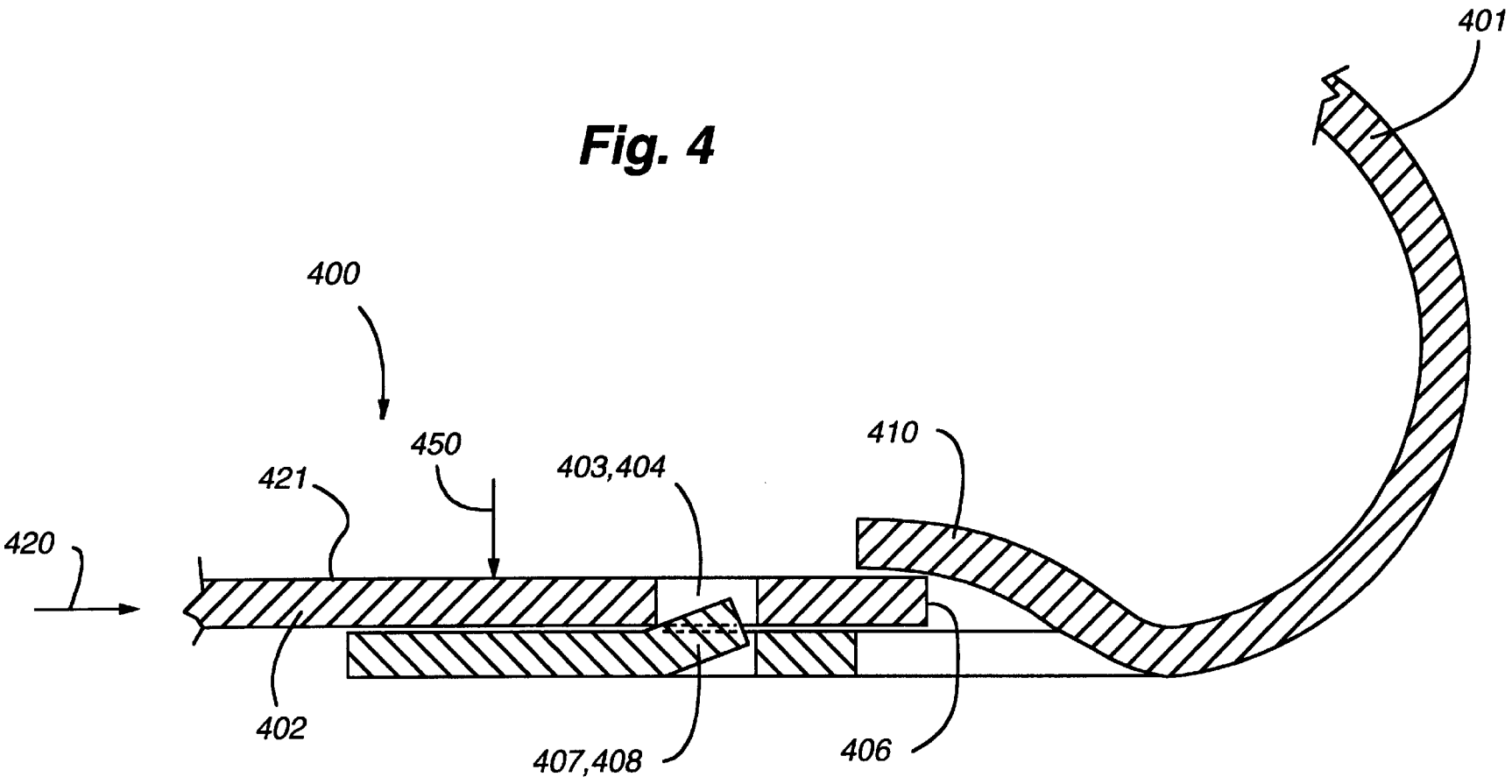
FIG. 4 is a partial side view of a third embodiment of a unitary data/credit card and paper money clip that is generally similar to the embodiment of FIG. 2, but wherein the unitary device is formed by the manually-releasable physical attachment of a first money clip portion to a second credit card portion, to thereby form one unitary member, this embodiment of the invention finding utility with capture type card readers wherein insertion of the credit card portion into the reader causes the credit card portion to be transported internally of the reader for reading of the data carrying member that is contained on or in credit card portion.
Figure 5:
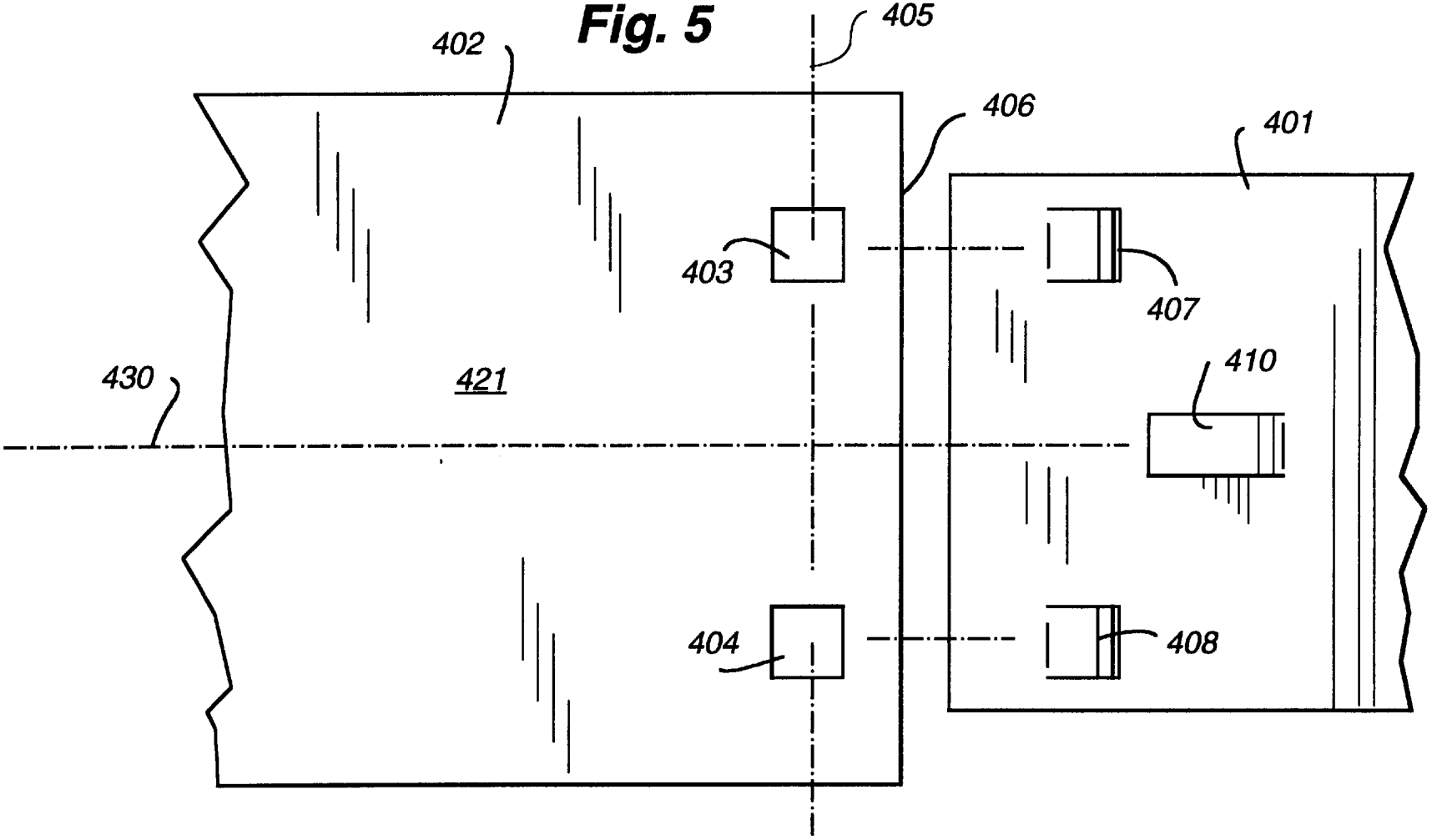
FIG. 5 is an exploded top view of the embodiment of FIG. 4, showing a preferred manner of releasably attaching or the mounting money clip portion onto the credit card portion.

FIG. 4 is a partial side view of a third embodiment of a unitary data/credit card and paper money clip 400 in accordance with the invention. The unitary device 400 is formed by a manually-releasable physical attachment of a first money clip portion 401, to a second credit card portion 402, to thereby form one unitary member 400. FIG. 5 is an exploded top view of the embodiment of FIG. 4 showing a preferred manner of releasably attaching, or mounting, money clip portion 401 onto credit card portion 402. A characteristic of this embodiment of the invention is that money clip portion 401 is usable to hold paper currency only when it is attached to credit card portion 402.

The construction and arrangement of this embodiment of the invention finds utility in use with capture-type card readers wherein insertion of credit card portion 402 into the reader causes credit card portion 402 to be transported internally of the reader, for reading of the data carrying member that is contained on or within credit card portion 402.

Credit card portion 402 is provided with two spaced openings, slots or through-holes 403,404. Holes 403 and 404 are positioned, or centered, on an axis 405 that extends generally parallel to the edge 406 of credit card portion 402.

Money clip portion 401 is provided with a pair of molded, or punched, upstanding tabs 407,408 that are located for cooperation with holes 403,404, respectively. When money clip portion 401 is removably mounted onto credit card portion 402, as it is in FIG. 4, tabs 407,408 penetrate holes 403,404, respectively.

Money clip portion 401 is also provided with a molded, or punched, upstanding capture-tab 410 that, in the mounted condition of FIG. 4, overhangs and captures credit card portion 402 onto money clip portion 401.

In order to mount credit card portion 401 onto money clip portion 401, a force represented by arrow 420 is applied to credit card portion 401. As a result of this force, credit card portion 402 slides under capture-tab 410, as tabs 407,408 seat themselves in holes 403,404, respectively.

In order to release credit card portion 402 from money clip portion 401, prior to insertion of credit card portion 402 into a capture-type reader, credit card portion 402 is bent upward and away from clip portion 401. For example, credit card portion 402 is bent upward about axis 430 of FIG. 5. This flexing of credit card portion 402 operates to release tabs 407,408 from holes 403,404. In this released condition, credit card portion 402 is now removed from money clip portion 401 by application of a force opposite to that indicated by arrow 420. Credit card portion 402 is now usable with a capture type reader. However, money clip portion 401 is no longer usable to hold paper currency.

Figure 6:
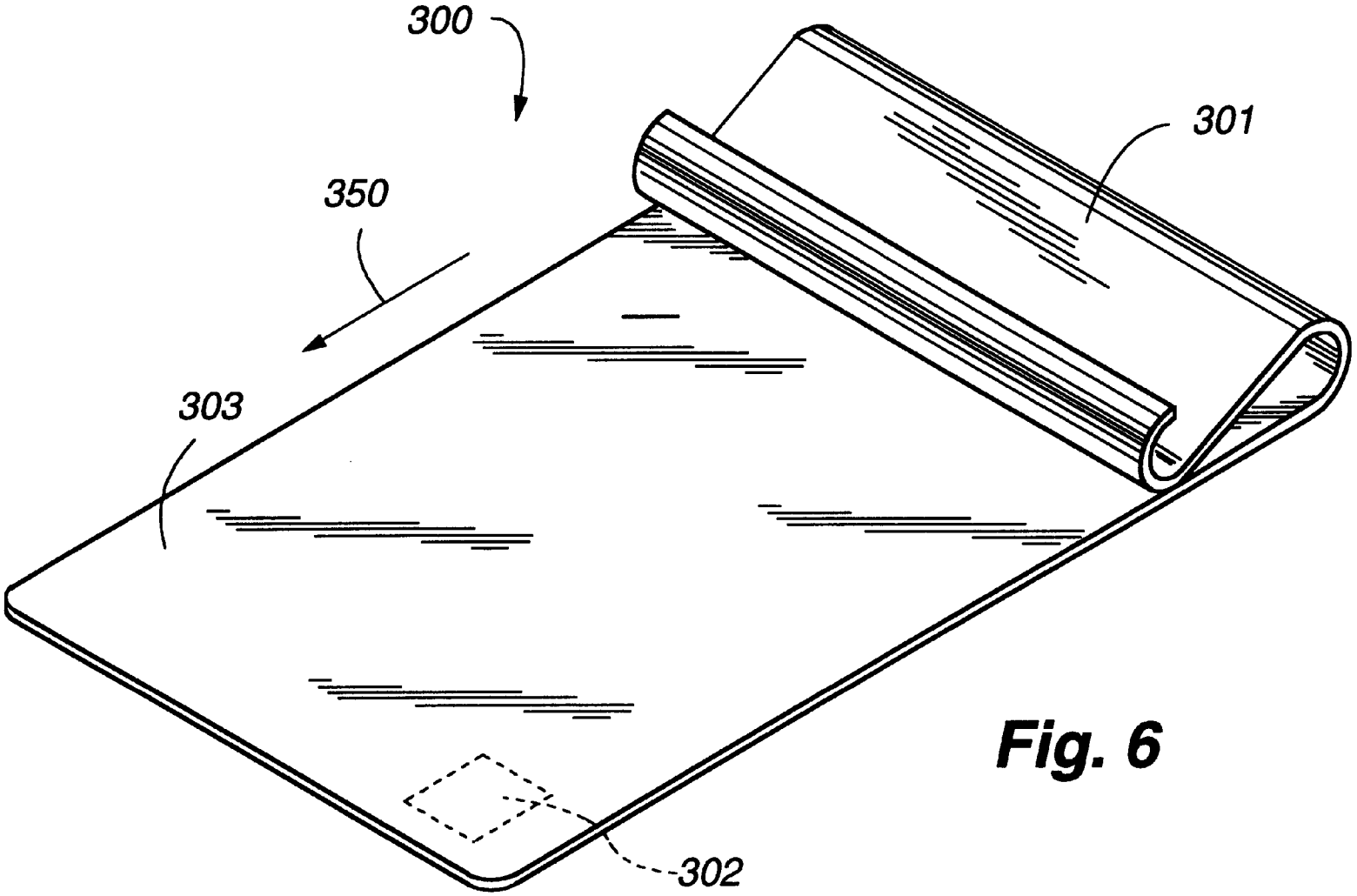
FIG. 6 is a perspective view of a fourth embodiment of a unitary data/credit card in accordance with the invention, wherein the money clip portion may be constructed and arranged in either the manner of FIG. 1, FIG. 2 or FIG. 4, and wherein the card's encoded data element comprises a semiconductor chip that is carried within the boundary of the flat data/credit card portion.

FIG. 6 is a perspective view of a fourth embodiment of a unitary data/credit card 300 in accordance with the invention, wherein money clip portion 301 may be constructed and arranged in the manner of FIGS. 1, 2 or 4, and wherein the card's encoded data element comprises a semiconductor chip 302 that is carried within the boundary of the flat portion 303 of data/credit card 300.

In this embodiment of the invention, money clip portion 301 is again placed on the top edge of card 300. However, when the aspect ratio of FIG. 6 is compared to FIGS. 1, 2 and 4, the top edge of card 300 corresponds to a side edge of the cards shown in FIGS. 1, 2 and 4. In this way, card 300 is more readily adapted for reading by insert data readers by an insertion action that is represented by arrow 350.

Flat portion 303 of card 300 carries an internally embedded semiconductor chip 302 that is encoded with the necessary data to be read by a data reader. Semiconductor chips of this type are well known, and will not be described herein.

The present invention has been described in detail while making reference to preferred embodiments thereof. Since it is apparent that those skilled in the art will readily visualize yet other embodiments that are within the spirit and scope of this invention, it is intended that the forgoing detailed description not to taken as a limitation on the spirit and scope of the invention.

What is claimed is:

1. A unitary and generally pocket size data-card/money-clip, comprising:

a flat and generally rectangular data-carrying-portion having a top edge, a bottom edge, a back surface, and a top surface;

a data-encoded element carried generally adjacent to said bottom edge of said data-carrying-portion;

a resilient clip-portion formed along said top edge of said data-carrying-portion so as to overhang and physically engage said top surface;

such that currency may be manually inserted under said clip-portion and securely held by tension within said clip-portion.

2. The data-card/money-clip of claim 1 wherein:

said data-encoded element is readable from said top surface.

3. The data-card/money-clip of claim 1 wherein:

said data-portion and said clip-portion are formed of a plastic material.

4. The data-card/money-clip of claim 3 wherein:

said plastic material is selected from the group PVC, ADS, and blends thereof.

5. The data-card/money-clip of claim 1 wherein:

said data-encoded element is readable from said top surface; and said data-encoded element is selected from the group data-encoded semiconductor element and data-encoded magnetic element.

6. The data-card/money-clip of claim 1 wherein said data-portion and said clip-portion are formed as separate elements, with said clip-portion being removably attached to said data-portion to thereby form an integral unit.

7. The data-card/money-clip of claim 6 wherein:

said data-encoded element is selected from the group data-encoded semiconductor element and data-encoded magnetic element.

8. The data-card/money-clip of claim 7 wherein:

said data-portion and said clip-portion are formed of a plastic material.

9. The data-card/money-clip of claim 8 wherein:

said plastic material is selected from the group PVC, ABS, and blends thereof.

10. A unitary and generally pocket size data-card/money-clip, comprising:

a flat and generally rectangular data-portion having a first side edge, a second side edge, a back surface, and a top surface;

a data-encoded semiconductor element carried by said data-portion at a position generally adjacent to said second side edge;

a resilient clip-portion formed along said first side edge so as to overhang and physically engage said top surface;

such that currency may be manually inserted under said clip-portion, said currency being securely held by tension within said clip-portion.

11. The data-card/money-clip of claim 10 wherein:

said data-encoded semiconductor element is readable from said top surface.

12. The data-card/money-clip of claim 11 wherein:

said data-portion and said clip-portion are formed of a plastic material selected from the group PVC, ABS, and blends thereof.

13. The data-card/money-clip of claim 12 wherein said data-portion and said clip-portion are formed as separate elements, with said clip-portion being removably secured to said data-portion to thereby form an integral unit.

14. A unitary and generally pocket size data-card/money-clip, comprising:

a flat and generally rectangular data-portion having a top edge and a bottom edge that are each about 2.00 inch long, two side edges that are each about 2.13 inch long, a flat back surface, and a flat top surface;

a data-encoded element carried by said data-portion generally adjacent to said bottom edge;

a resilient clip-portion formed along said top edge of said data-portion so as to overhang said top surface;

said clip-portion joining said top edge with a generally 270-degree fold having a radius of about 0.13-inch;

said clip-portion having a length of about 0.75 to about 1.00-inch measured in a direction extending toward said bottom edge, said clip-portion terminating at physical contact with said top surface, and at an upward curved portion having a radius of about 0.10-inch that extends away from said top surface, and said data-portion and clip-portion being formed of plastic selected from the group PVC, ABS, and blends thereof.

15. The data-card/money-clip of claim 14 wherein:

said data-encoded element is selected from the group data-encoded semiconductor element and data-encoded magnetic element.

16. The data-card/money-clip of claim 15 wherein said resilient clip-portion is formed as a separate member, and including means for permanently or manually-releasably securing said separate member to said data-portion.

* * * * *